United States Patent [19]

Palnik

[11] Patent Number: 4,610,772

[45] Date of Patent: Sep. 9, 1986

[54] ELECTROLYTIC PLATING APPARATUS

[75] Inventor: Karl Palnik, Huntingdon Valley, Pa.

[73] Assignee: The Carolinch Company, Ivyland, Pa.

[21] Appl. No.: 757,794

[22] Filed: Jul. 22, 1985

[51] Int. Cl.[4] ..... C25D 17/00; C25D 17/28

[52] U.S. Cl. ..... 204/206; 204/224 R

[58] Field of Search ..... 204/206, 224 R

[56] References Cited

U.S. PATENT DOCUMENTS 4,361,470 11/1982 Eidschun ..... 204/15

4,452,684 6/1984 Palnik ..... 204/206

*Primary Examiner*—T. M. Tufariello

*Attorney, Agent, or Firm*—Charles H. Lindrooth

[57] ABSTRACT

A rotary brush plating apparatus utilizing a porous brush member formed of a hydrophobic material is disclosed. Plating solution is pumped interiorly of rotating, cylindrical brush member and radially outwardly through interconnected pores to its periphery where plating takes place by the passage of parts lengthwise of the brush member in contact with its surface. A continuous circulation of plating solution is provided so that an adequate supply is always provided on the brush surface. Means are provided for recapturing excess solution for return to the reservoir.

10 Claims, 9 Drawing Figures

10
45a
37
18
45
42
28
25
45a
10
27
47
36
37
50
8
8
51
23
58
56
24
24
15
(+)
57
21
57

ELECTROLYTIC PLATING APPARATUS

FIELD OF THE INVENTION

This invention relates to electrolytic plating of small metal parts, usually interconnected in strip form and more particularly to the plating of such parts with precious metals by the so-called brush or selective application method.

BACKGROUND OF THE INVENTION

Techniques for continuous brush plating utilizing a porous brush member made of a hydrophobic material are described and claimed in my U.S. Pat. No. 4,452,684 issued June 5, 1984. In that patent, high speed plating of parts is accomplished by passing the parts lengthwise of a stationary brush member with the parts in contact with the surface of that member. According to that patent, the brush member is formed of a hydrophobic material having interconnected pores. A distribution conduit located centrally of the brush member is used for distributing plating solution outwardly through the pores to maintain a continuous supply of fresh solution on its periphery. The brush member disclosed in that patent preferably is covered with a screen-like material serving as an anode and has a soft porous outer covering along which the parts to be plated are "brushed." Preferably the stationary brush member has at least one planar surface, a sharply radiused surface and one relatively large radiused surface extended lengthwise thereof, each of which may be positioned along the path of the parts, for the purpose of plating parts of different shapes. Rapid, selective plating of small portions of metal parts is a achieved because a constantly replenished supply of plating solution is present on the brush surface and is available for the plating of a selected surface of a part.

Rotatable cylindrical brush members arranged so that the surface of an absorbent brush is dipped into a bath of an electrolytic plating solution, or in which the solution is somehow poured onto the surface, are known in the art. Uniformity of amount of metal plated on the part is difficult to achieve with such arrangements, at least in part because of the difficulty of maintaining a uniform and continuous supply of metallic ions on the surface of the brush member. The rate of plating is relatively low, due in large part to ion depletion in the plating solution.

Both the approach in my prior U.S. Pat. No. 4,452,684 and the rotary brush approach as described for example in U.S. Pat. No. 4,361,470 have important advantages. High production rates and a precisely controlled application of plating material are among the objects and advantages obtained with the brush disclosed in U.S. Pat. No. 4,452,684. However, for many uses, rotary brushes have important advantages. When an elongated part is passed lengthwise of a rotating cylindrical brush in tangential contact with its periphery, rotary brush plating techniques inherently produce a grain structure of the plating material on the part which runs substantially lengthwise of the part. For parts serving as connectors, this lengthwise grain structure, which extends parallel to the direction of insertion and removal of the plated connector, results in a reduction of the wear of the plated material from the part.

OBJECTS AND ADVANTAGES OF THE INVENTION

With the foregoing in view, an important object of my invention is the provision of a rotary brush plating technique which combines the advantages of rotary brush plating with those achieved with the invention disclosed and claimed in my prior U.S. Patent identified above.

A further object of the invention is the provision of the plating equipment which is useful for plating, utilizing alternatively soluble or insoluble anode plating techniques.

A further object of the invention is the provision of a rotary brush plating apparatus with which very high production rates are achievable as compared with prior art rotary plating brushes.

The above and other objects and advantages of the invention will become apparent from the detailed description of an illustrative embodiment of the invention and from the accompanying drawings.

DETAILED DESCRIPTION OF THE ILLUSTRATIVE EMBODIMENT

Figures 1, 1A:
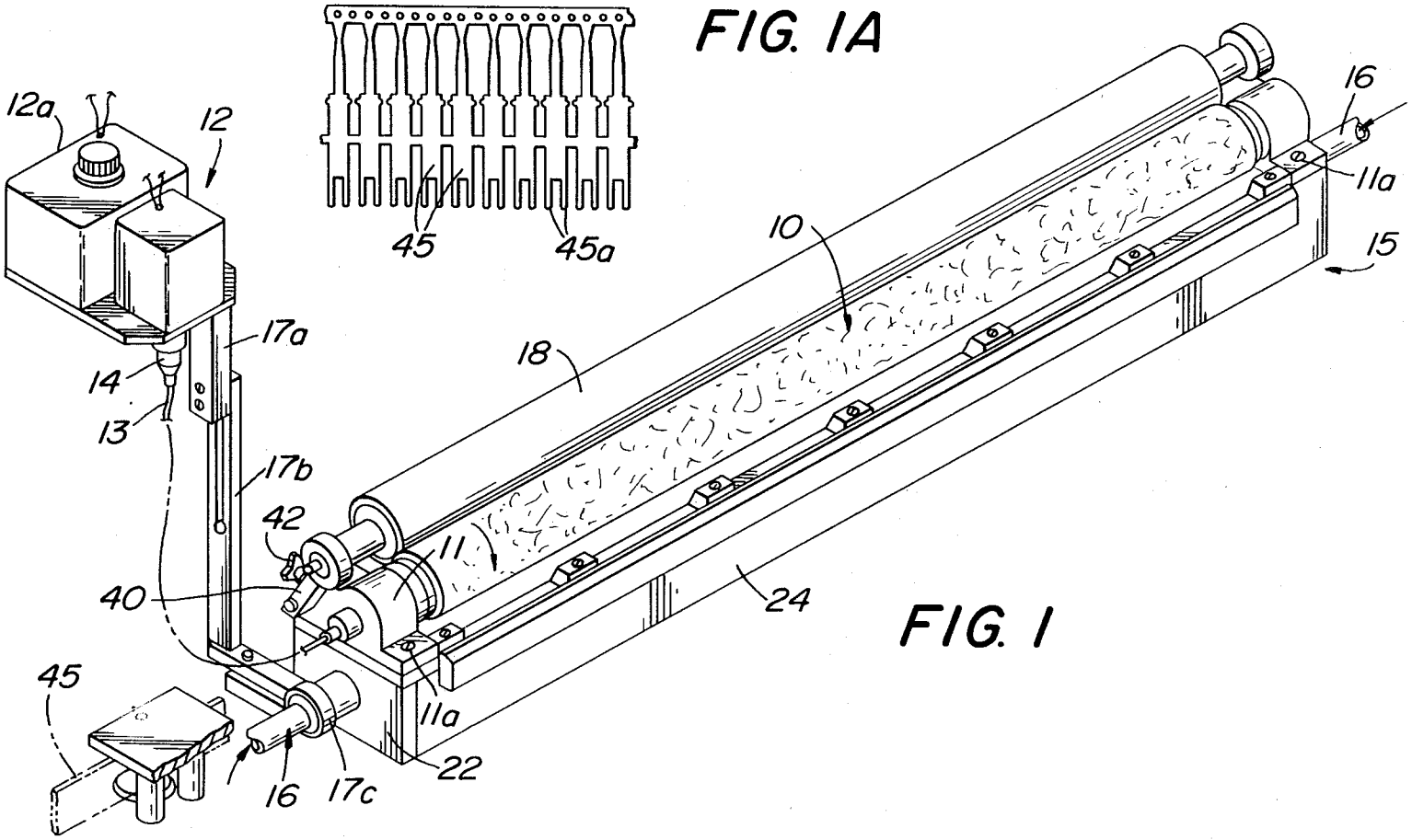
FIG. 1 is a perspective view showing a preferred form of plating apparatus incorporating the principles of the invention.
FIG. 1*a* is a view showing an example of interconnected metal connector parts of a type which may be plated using the equipment of the present invention.
Figure 2:
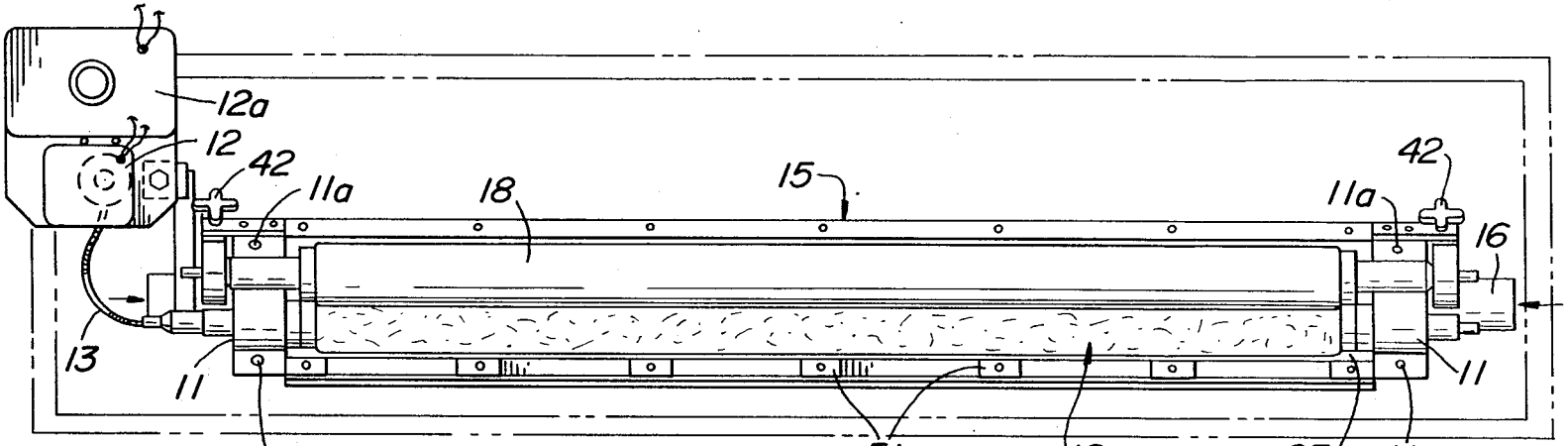
FIG. 2 is a plan view of the apparatus shown in FIG. 1.
Figure 4:
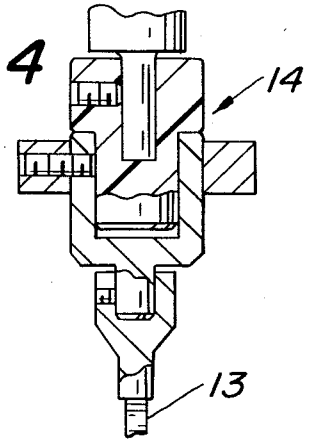
FIG. 4 is a sectional view taken on line 4—4 of FIG. 3.
Figure 6:
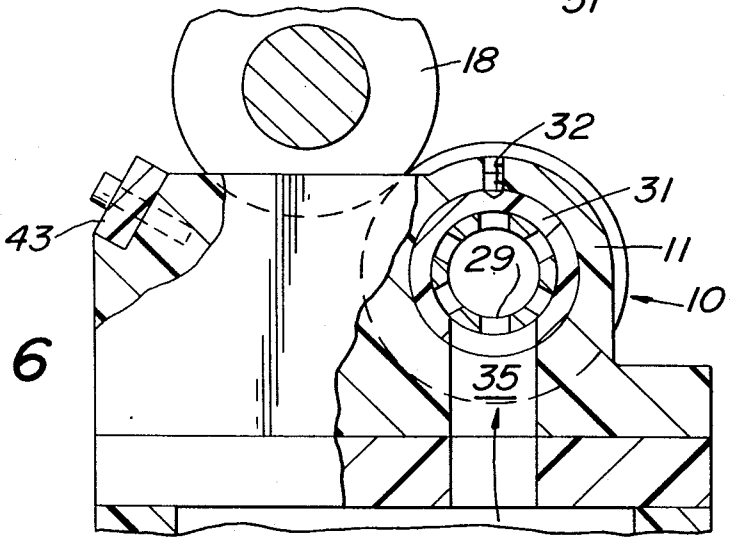
FIG. 6 is a sectional view taken on line 6—6 of FIG. 5.

Reference is first made to FIG. 1 which shows an overall view of a rotary brush plating apparatus incorporating the principles of the invention. The apparatus shown comprises cylindrical plating brush member 10, described more particularly hereinafter, which is mounted for rotation in spaced apart bushing housings 11. Brush member 10 is driven by a motor 12 through a flexible drive shaft 13, through an insulating coupling member 14.

Bushing housing members 11 which rotatively support the brush member are mounted on the top of a tank 15. Circulation means comprising conduits 16 deliver a continuous supply of plating solution to the tank, the solution being supplied under pressure by a pump not shown.

A vertical support standard for the motor comprising a pair of upright members 17*a* and *b*, adjustably interconnected by bolts extending through openings in the members, one of which is an elongated slot. A clamp 17*c* secures the upright member 17*b* to the conduit 16.

Figures 7, 8:
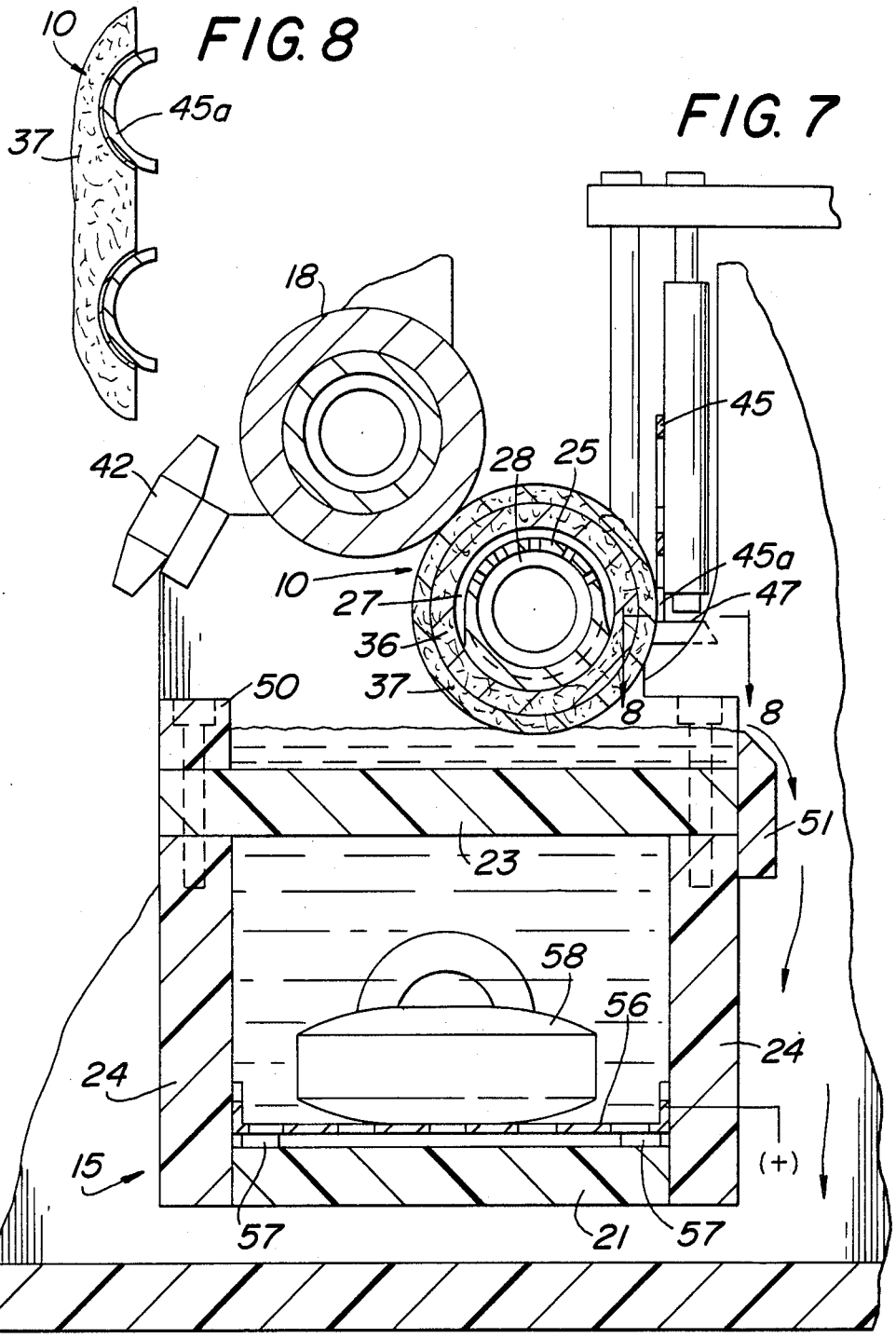
FIG. 7 is a sectional view taken on line 7—7 of FIG. 5.
FIG. 8 is a fragmentary sectional view taken on line 8—8 of FIG. 7.

Means to be described hereinafter distribute the plating solution from the tank 15 to a centrally located conduit extending lengthwise of brush member 10 from which the solution is delivered radially outwardly through interconnected pores to the periphery of the brush member. Excess plating solution accumulates in a tray formed on top of tank 15, as can be seen in FIG. 7, and is returned to a larger tank underneath tank 15, all as is described more fully hereinafter.

Figure 3:
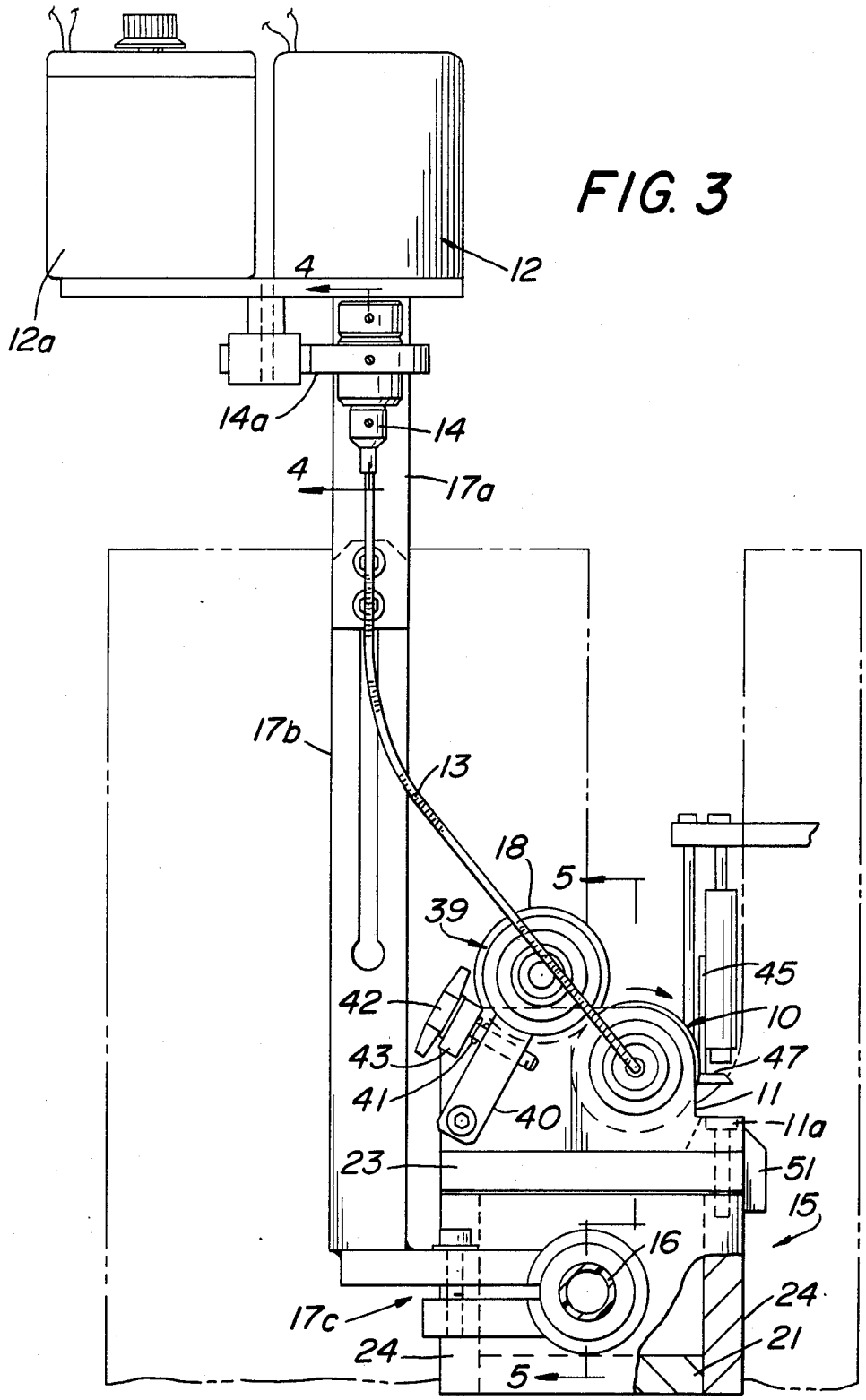
FIG. 3 is a side elevational view of the apparatus shown in FIG. 2.

Reference is now made to FIGS. 2–8, FIG. 2 being a plan view and FIG. 3 an end view of the apparatus shown in FIG. 1. Tank 15 is comprised of the bottom wall 21, end walls 22, a lid or top 23 and side walls 24. Conduits 16 provide for a fresh supply of plating fluid to be continually delivered to the interior of tank 15.

Figure 5:
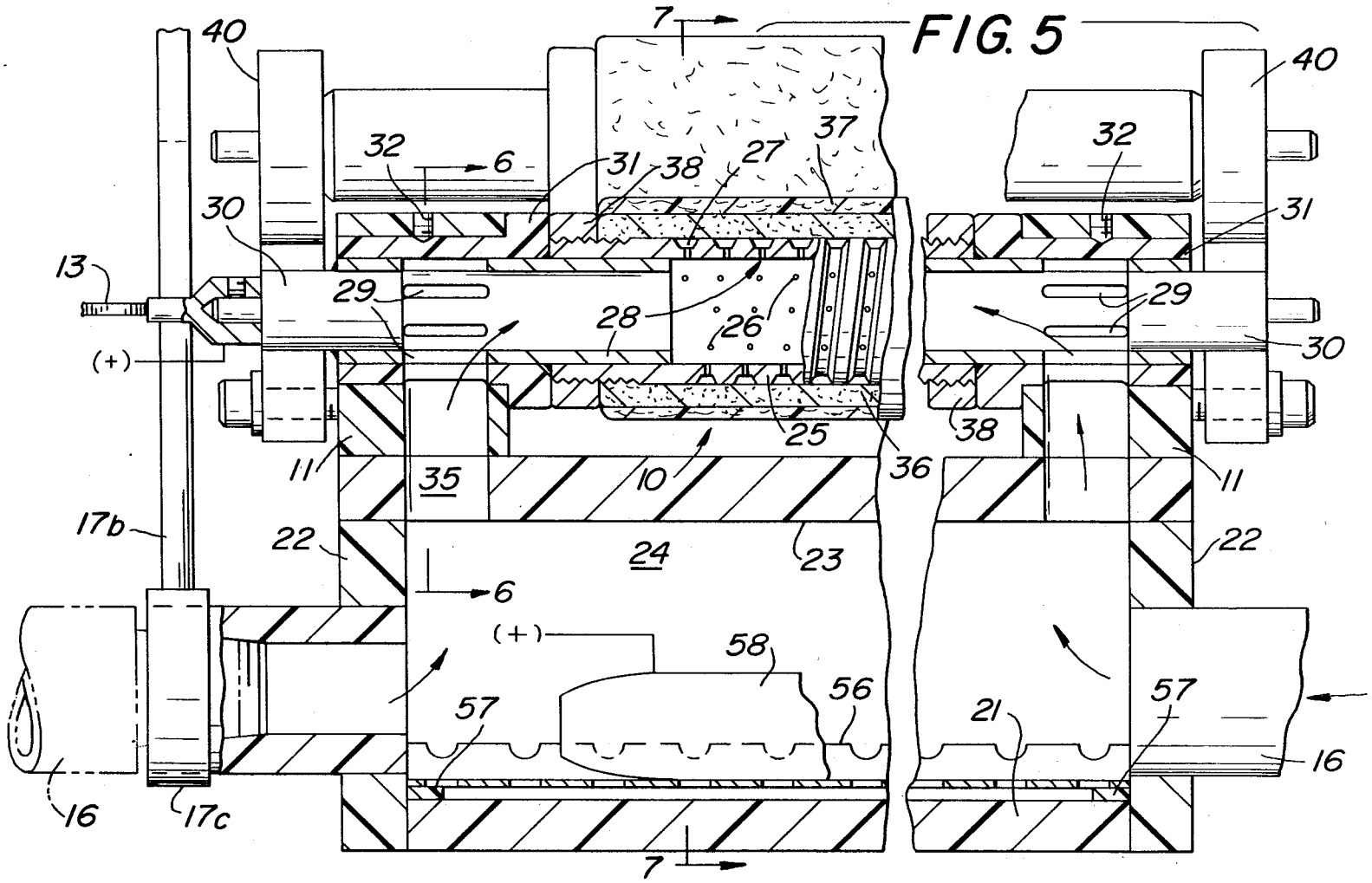
FIG. 5 is a sectional view on an enlarged scale with respect to FIG. 3, taken on lines 5—5 of FIG. 3.

As seen in FIG. 5, bushing housings 11 are mounted on the upper surface of lid 23 and are fixed in position by any suitable means such as machine screws 11*a*.

In the preferred embodiment the axially extending conduit within brush member 10 comprises a hollow sparger tube 25 having radially extended openings 26 spaced along its entire length. The openings 26 extend from the interior of the tube into a spiral external groove 27 which extends lengthwise of the tube as shown in FIG. 5. Preferably, sparger tube 25 is fabricated of a conductive material suitable for use as an anode in the applications for which the plating equipment is intended whereas other parts contiguous thereto are non-conductive. In the illustrative embodiment sparger tube 25 is formed of titanium metal.

The ends of tube 25 are fitted with electrically conductive sleeve-like tubular sections 28, secured by welding or other suitable means. Each is provided with circumferentially spaced distribution slots 29. Conductive stub shafts 30 plug the ends of the tubular sections 28 and preferably are welded or otherwise secured therein. As schematically shown at 25*a* in FIG. 5, a positive potential is applied to tube 25. Preferably electrical contact is made from a power supply via a commutator ring 14*a* mounted on the conductive outer part of coupling 14 and electrically conductive flexible shaft 13.

The bushing housings 11 are fitted with sleeve bearings or bushings 31 within which the ends of the tubular sections 28 are journaled. Bushings 31 are preferably removably mounted within the bushing housings 11 by means such as set screws, also shown in FIG. 6.

As can be seen with reference to FIGS. 5 and 7, fluid passageways 35 extend upwardly through the top of covering 23 of tank 15, through the bushing housings 11, the bushings 31 and through the distribution slots 29, thereby providing a flow path from the tank to the interior of the distribution conduit within the sparger tube 25.

As disclosed in my prior U.S. Pat. No. 4,452,684, the brush member further comprises an elongated porous body portion 36 formed of hydrophobic material having interconnected pores distributed throughout so as to be liquid pervious. Suitable molded porous polypropylenes are manufactured by the Glassrock-Porex division, Fairburn, Ga. 30212, under the trademark POREX, by Hedmex Chemical Corp., Brooklyn, NY 14222, under the trademark INTERFLO PLASTIC and porous polypropylenes sold by General Polymeric Corp., 621 Franklin St., W. Reading, PA 19611. Pore sizes may vary somewhat, larger pores and greater pore density permitting faster plating rates, but at the same time making selective plating of a part more difficult to control. As a generality, porous polypropylene having pore sizes in the range of 100 to 200 micro inches in diameter produces excellent results. In the present invention body portion 36 is cylindrical so that negatively charged parts placed in tangential contact with its rotating periphery and moved lengthwise thereof receive a continuous application of fresh plating solution.

If desired, a soft, porous, absorbent cover 37 may be provided on the porous body member 36. As shown in FIG. 5, the ends of sparger tube 25 may be threaded to receive retaining nuts 38 which hold the cylindrical body member in place.

As can be seen in FIGS. 3 and 5, a metering roll 39 is mounted on spaced apart arms 40 pivotally mounted on the tank end walls 22 and spring urged by any suitable means such as coil springs 41 so as to urge the roll against the surface of roll 10. Coil springs 41 are mounted on adjusting screws 42 which are passed through members 43 fixed to the tank and the screws are threaded into the arms 40 for the purpose of varying the pressure exerted by the springs. In the preferred embodiment roll 39 is a duplicate of brush member 10, complete with hollow sparger tube and absorbent covering so that the user has a replacement part should brush member 10 need replacement.

In a typical plating operation of the kind with which the invention is concerned, the electrical contacts to be plated are interconnected at the time of plating in strip form and later separated, although in some applications the separate parts may be releasably mounted on a carrier strip or belt, a typical series of interconnected parts 45 being illustrated in FIG. 1*a*. An end-wise view of the strip of parts is illustrated at 45 in FIGS. 3 and 7. As seen in FIGS. 3 and 7, the parts are drawn along a path extending lengthwise of the brush member 10 with the portion to be plated, identified by numeral 45*a* touching the cover. Guide or transport means comprising a series of guide rollers 46 are placed at spaced locations lengthwise of the apparatus to maintain the parts in contact with the cover. The guide means preferably also includes conically shaped guide members 47 to support the parts in the desired vertical orientation as they pass lengthwise of the brush member.

From the above, it should be apparent that plating solution, pumped through conduit 16, fills tank 15 and flows upwardly through passages 35 in the bushing housings 11, through distribution slots 29 filling the inside of sparger tube 25 and passing through openings 26 into helical groove 27. The fluid is forced radially outwardly through the interconnected pores in cylindrical body 36 and continuously and substantially uniformly flows onto the soft porous covering 37.

In order to catch the excess fluid flowing from the surface of brush member 10, a reservoir or tray defined by the sides of the bushing housings 11, a narrow wall 50 bolted along one side of the tank and a wall or dam 51 bolted to the opposite side of the tank are provided. Preferably dam 51 is adjustably mounted for vertical movement so as to control the level of plating fluid to the point where the bottom surface of the brush member just contacts the solution.

The excess plating solution will flow over dam 51 into a larger reservoir 52 from which it is recirculated to the brush via the circulation system previously described.

The apparatus of the present invention is also adaptable for utilization of soluble anodes. For this purpose an anode support means comprising pan 55 is positioned to support a soluble anode illustrated at 56 within tank 15. Preferably pan 55 is supported in spaced relationship above the bottom of tank 15 by feet 57 and is preferably formed of perforated metal to maximize contact between the electrolytic solution and the soluble anode 56. To permit use of soluble anodes, tank 15 is formed of any electrically non-conductive material and means, including a conductor schematically shown at 58, for applying a positive charge to the anode is provided. As will be understood, the anode should be at the same or a lower potential than tube 25 to prevent plating of the tube.

It can be seen that a rapid and effective means of plating a large volume of parts is provided. Since the parts are plated by the action of a rotating brush, grain structure progresses in the direction of rotation. As connector parts are moved lengthwise of the rotating brush by the transport means so the long axes of the connector elements extend perpendicularly to the direction of their movement, the grain structure extends lengthwise of the elements. Plating is achieved on one side of a part only and since fresh plating solution is continually delivered to the brush surface plating is effected rapidly with a high degree of uniformity from part to part.

I claim:

1. Apparatus for rotary brush plating of metal parts comprising: a rotatably mounted cylindrical body, said body being comprised of a hydrophobic material and having interconnected pores substantially uniformly dispersed throughout, extending radially outwardly to the periphery, said body further having a centrally located distribution conduit extending lengthwise thereof; a reservoir of plating solution; means for delivering plating solution under pressure from said reservoir to said distribution conduit and from the distribution conduit radially outwardly through the pores to the periphery of said body, positively-charged anodic means for imparting positive charge to the plating solution on the periphery of said body, means for rotating said body; and means for passing said parts along a path extending lengthwise of the body with the part surface to be plated in contact with the periphery of the rotating body.

2. A brush member according to claim 1 wherein said means for delivering plating solution under pressure comprises circumferentially spaced slots in the distribution conduit, said slots being located adjacent the ends of the conduit, a pair of fixed journal housings each having a journal bearing for support of the conduit in the region of said slots and a passageway extending through said housing and said journal bearings for fluid communication to said distribution conduit from said reservoir through said slots.

3. A brush member according to claim 2 wherein said conduit is formed of an electrically conductive material, said means for imparting a positive charge to said plating solution including means for positively charging said conduit.

4. A brush member according to claim 3 wherein said means for rotating said body comprises a motor having a flexible drive shaft coupled to said body and means including a drive shaft coupling of insulating material between the motor and the body.

5. Apparatus according to claim 4 comprising a tray beneath said cylindrical body for accumulating plating solution passing from the periphery of the body and means for continuous recirculating of said plating solution to the reservoir.

6. Apparatus according to claim 5 wherein said means for accumulating plating solution comprises a dam disposed on one side of said tray, said dam being vertically adjustable for regulation of the depth of solution in the tray.

7. Apparatus according to claim 6 wherein said dam maintains the level of the plating solution in contact with the periphery of the brush.

8. Apparatus for rotary brush plating comprising a reservoir of electrolytic plating solution, an elongated rectangular tank mounted within the reservoir, means for circulation of said plating solution from the reservoir to the tank, an elongated cylindrical brush member formed of a porous, hydrophobic material, support means on said tank for rotatably mounting said brush member, a passage means through said brush member support means for passing plating solution from the tank to the interior of said brush member, the pores of the brush member being interconnected whereby plating solution delivered thereto radiates outwardly to the brush member periphery, positively-charged anodic means for positively charging the plating solution and means for transporting negatively charged parts to be plated lengthwise of the brush member with the portion to be plated in contact with the brush member periphery.

9. Apparatus for rotary brush plating comprising a cylindrical brush member, said brush member comprising a cylindrical body formed of a porous hydrophobic material, wherein the pores are interconnected and extend radially outwardly to the brush member periphery, means for rotating said brush member, a distribution system for electrolytic plating solution comprising a conduit for distributing plating solution under pressure interiorly of said rotating cylindrical body and for continuously passing said solution outwardly thereof whereby a fresh supply of solution is maintained on the periphery, transport means for passing a part to be plated lengthwise of the brush member with the portion to be plated in contact with the brush member periphery and positively-charged anodic means for positively charging the solution and negatively-charged cathodic means for negatively charging the part.

10. Apparatus according to claim 9 wherein the part to be plated is an elongated electrical contact, and wherein said transport means orients the part with the long axis of the contact extended in the direction of the rotation of the cylindrical body member during contact with the body member periphery.

* * * * *